US006670001B2

(12) United States Patent
Kohsaka

(10) Patent No.: US 6,670,001 B2
(45) Date of Patent: Dec. 30, 2003

(54) FLAME-RETARDANT FABRIC FOR INK-JET RECORDING AND PROCESS FOR MANUFACTURING THE SAME

(75) Inventor: Takahiro Kohsaka, Fukui (JP)

(73) Assignee: Seiren Co., Ltd., Fukui (JP)

( * ) Notice: Subject to any disclaimer, the term of this patent is extended or adjusted under 35 U.S.C. 154(b) by 0 days.

(21) Appl. No.: 10/082,505

(22) Filed: Feb. 25, 2002

(65) Prior Publication Data

US 2002/0164462 A1 Nov. 7, 2002

(30) Foreign Application Priority Data

Feb. 26, 2001 (JP) ..... 2001-051298

(51) Int. Cl.[7] ..... B41M 5/00

(52) U.S. Cl. ..... 428/32.24; 428/32.16; 428/32.21; 428/32.25; 428/32.3; 428/32.34; 428/32.38; 442/136; 442/141; 442/146; 442/144; 442/145

(58) Field of Search ..... 442/136, 141, 442/146, 144, 145; 428/195, 213, 336, 920, 32.16, 32.21, 32.24, 32.25, 32.3, 32.34, 32.38

(56) References Cited

U.S. PATENT DOCUMENTS 4,877,679 A * 10/1989 Leatherman et al. ..... 428/224
4,879,148 A * 11/1989 Neaves et al. ..... 428/40
5,013,634 A * 5/1991 Nagai ..... 430/495
5,618,546 A * 4/1997 Wood et al. ..... 424/402
5,693,410 A * 12/1997 Malhotra et al. ..... 428/216
5,827,788 A * 10/1998 Miyakoshi ..... 442/164
6,025,063 A * 2/2000 Nakao et al. ..... 428/304.4
6,326,323 B1 * 12/2001 Shimano et al. ..... 442/76

FOREIGN PATENT DOCUMENTS

JP 2000-203148 7/2000
JP 2000-303361 10/2000

* cited by examiner

*Primary Examiner*—Cynthia H. Kelly
*Assistant Examiner*—B. Shewareged
(74) *Attorney, Agent, or Firm*—Flynn, Thiel, Boutell & Tanis, P.C.

(57) ABSTRACT

A sufficiently flame-retardant fabric for ink-jet recording with an ink accepting layer on its one side at least, the ink acceptability (ink holding capability) of which is the same as that of its non-flame-retardant counterpart, allowing the fabric to render highly deep/brilliant shade and sharp color images. The flame-retardant fabric for ink-jet recording includes a flame retarded fiber substrate with an ink accepting layer on its one side at least, which is made up of a 3–12 μm-thick top sub-layer and a bottom sib-layer with a flame retarding agent contained only in the bottom sub-layer wherein the flame retarding agent has its active ingredient applied to the substrate in an aqueous dispersion, accounting for 4 to 30% of the entire ink accepting layer by weight.

16 Claims, 2 Drawing Sheets

FLAME-RETARDANT FABRIC FOR INK-JET RECORDING AND PROCESS FOR MANUFACTURING THE SAME

FIELD OF THE INVENTION

The present invention relates to a fabric for ink-jet recording and a process for manufacturing the same, and more particularly to a sufficiently flame-retardant fabric for ink-jet recording with an ink accepting layer on its one side at least, the ink acceptability of which is the same as that of its non-flame-retardant counterpart.

BACKGROUND OF THE INVENTION

In recent years, large-sized ink jet equipment intended for ink-jet printing onto paper, resin sheet and other similar substrates have been developed. Such ink jet equipment provides for manufacturing of large-size products printed with deep- and brilliant-shade full color, only possible to manufacture with ink-jet printing, such as hanging screens and banners having lengths exceeding several meters. However, such hanging screens and banners manufactured using paper, resin sheet and other similar material as their substrates are not necessarily resistant to bending (and are thus liable to crease), while presenting problems associated with strength such as durability.

As a substitute for such ink-jet printing substrates, fiber fabric which is light in weight and highly resistant to bending, as well as excellent in durability and tear strength, has attracted attention. As its characteristic feature, however, fabric has such large surface irregularities compared to those of paper or resin sheet (the surface of which is smooth) that particles of coloring material in the ink applied onto the fabric are liable to diffuse over and into it, resulting in its poor surface shade depth. This makes it difficult for ink-jet printing onto fabric to achieve such a brilliant color image as achieved in the case with paper or resin sheet.

On the other hand, fabric, which is generally liable to catch fire or inflammable, is often required to be more flame retardant if used as a substrate of a hanging screen or banner for indoor use than otherwise. To meet such requirements in the field of ink-jet printing, one prior proposal is to prepare fabric with an ink accepting layer which is flame retarded, which, however, has proved to result extremely difficult representation of a highly deep and brilliant shade color image onto the fabric. This is also the case when the ink to be applied onto such fabric is of a type prepared with its water insoluble coloring matter dispersed in water. Many techniques have been disclosed to provide effective methods for ink-jet printing of paper and resin sheet with highly deep and brilliant shade color representation as well as flame retardancy. However, it is impossible to apply these techniques to fabric, which has surface irregularities and a peculiar propensity to cause the ink applied to it to bleed (with poor ink dot shape), in the same way as in the case of paper or resin sheet.

Therefore, techniques have also been developed for ink-jet printing on fabric to provide it with both highly deep and brilliant shade color and flame retardancy. According to one such prior technique as disclosed in Japanese Patent JP-A-2000-203148, a synthetic fiber fabric is pretreated to form an ink accepting layer on its one side and a flame-retardant layer on its other side. This technique, however, has the disadvantage that any increase in the amount of ink applied to fabric to enhance the color shade depth on the fabric necessarily requires it to be pretreated with a thicker ink accepting layer, which is not sufficiently flame retardant, causing its printed ink accepting layer side to become insufficiently resistant to heat.

According to another such prior technique as disclosed in Japanese Patent JP-A-2000-303361, a fabric is impregnated with an ink acceptor to form an ink accepting layer on the fabric and then with a flame retarding agent to make it flame retardant as a whole. However, this technique has the disadvantage of necessitating the ink accepting layer formed on fabric to be covered with a subsequently applied flame retardant agent and any dispersant and/or viscosity improver contained in the agent, resulting in deterioration in its ink accepting function that may not otherwise occur. Fabric treated according to the above-mentioned prior technique, especially when printed with ink of water-insoluble coloring matter dispersed in water, fails to yield deep shade and sharp color images.

Therefore, among the prior art disclosures found to deal with fabric for ink-jet recording with an ink accepting layer on its one side to apply solvent-based ink or water-based ink, especially ink of water-insoluble coloring matter dispersed in water, onto the ink accepting layer to represent deep shade and sharp color images, there are none which address the problem of manufacturing a sufficiently flame-retardant fabric for ink-jet recording with an ink accepting layer on its one side, the ink acceptability of which is the same as that of its non-flame-retardant counterpart.

SUMMARY OF THE INVENTION

Accordingly, it is an object of the present invention to solve the above-mentioned problems associated with the prior art, thereby providing a sufficiently flame-retardant fabric for ink-jet recording with an ink accepting layer on its one side at least, the ink acceptability (ink holding capability) of which is the same as that of its non-flame-retardant counterpart, allowing it to render highly deep/brilliant shade and sharp color images.

The present invention has successfully solved the above-mentioned prior art problems through its features as described below. One aspect of the present invention provides a flame-retardant fabric for ink-jet recording, consisting of a flame retarded fiber substrate with an ink accepting layer on its one side at least, which is made up of top and bottom sub-layers with a flame retarding agent contained only in the bottom sub-layer.

Another aspect of the present invention provides a flame-retardant fabric for ink-jet recording wherein said flame retarding agent has its active ingredient accounting for 4 to 30% of the entire ink accepting layer by weight.

Still another aspect of the present invention provides a flame-retardant fabric for ink-jet recording, wherein said flame retarding agent is readily soluble or dispersible in water or aqueous solvent.

A further aspect of the present invention provides a flame-retardant fabric for ink-jet recording, wherein said top sub-layer is 3 to 12 $\mu$m in thickness.

A still further aspect of the present invention provides a flame-retardant fabric for ink-jet recording, consisting of a flame retarded fiber substrate with an ink accepting layer on its one side at least, which is made up of a top sub-layer 3 to 12 $\mu$m in thickness and a bottom sub-layer with a flame retarding agent contained only in the bottom sub-layer, wherein said flame retarding agent has its active ingredient applied to the substrate in an aqueous dispersion, accounting for 4 to 30% of the entire ink accepting layer by weight.

Another aspect of the present invention provides a process for manufacturing a flame-retardant fabric for ink-jet recording, consisting of a flame retarded fiber substrate with an ink accepting layer on its one side at least, by forming said ink accepting layer as two sub-layers in two steps—first, a bottom sub-layer containing a flame retarding agent and then, a top sub-layer containing no flame retarding agent.

Yet another aspect of the present invention provides a process for manufacturing a flame-retardant fabric for ink-jet recording, consisting of a flame retarded fiber substrate with an ink accepting layer on its one side at least, by forming said ink accepting layer as two sub-layers in two steps—first, a bottom sub-layer containing a flame retarding agent and then, a top sub-layer 3 to 12 $\mu$m in thickness containing no flame retarding agent.

A further aspect of the present invention provides a process for manufacturing a flame-retardant fabric for ink-jet recording, wherein said flame retarding agent has its active ingredient accounting for 4 to 30% of the entire ink accepting layer by weight and is readily soluble or dispersible in water or aqueous solvent.

It is within the scope of the invention to combine two or more of the above features.

PREFERRED EMBODIMENT OF THE INVENTION

Figure 1:
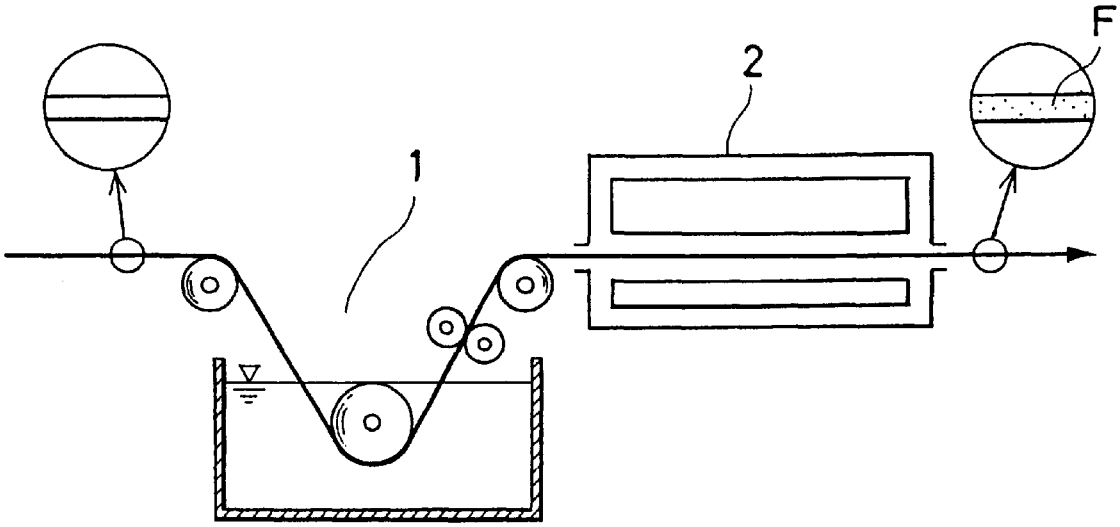
FIG. 1 illustrates a dipping system for applying a flame-retardant finish to a cloth as a substrate of a fabric for ink-jet recording of the present intention, and a drying system linked with the dipping system to dry the flame retardant finished cloth after such finishing.

The above-mentioned aspects of the present invention are more specifically explained by describing its representative embodiments which are as follows. The basic feature of the present invention which characterizes it is the provision of a flame-retardant fabric for ink-jet recording, consisting of a flame retarded fiber substrate with an ink accepting layer on its one side at least, which is made up of top and bottom sub-layers with a flame retarding agent contained only in the bottom sub-layer. The term "top sub-layer" as used herein refers to one of the two components constituting an ink accepting layer formed on the surface of a fiber substrate according to the present invention, which is located remote from the fiber substrate surface, while the term "bottom sub-layer" as used herein refers to the other component of the ink accepting layer, which is located close to the fiber substrate surface.

The present invention, as a prerequisite for accomplishment of its purpose, requires the use of a flame retarded cloth as a substrate of its intended flame retardant fabric for ink-jet recording. The useful flame retarded fiber substrates of flame-retardant fabric contemplated by the present invention include flame-retardant rayon such as BELLFLAME (Kanebo, Ltd.) or TOBIREN (Toho Rayon Co. Ltd.) made by spinning cellulose blended with a phosphorus-based flame retarding agent, flame-retardant acrylic fiber such as KANEKARON (Kaneka Corporation), LUFNEN (Kanebo, Ltd.) or EXLAN NX (Toyobo Co., Ltd.) made by copolymerizing acrylonitrile with vinyl chloride or vinylidene chloride, flame-retardant vinylon such as VINARL (Kuraray CK, Ltd.), flame-retardant polyester such as TETRON UNFLA (Toray Industries, Inc.), EXTER (Teijin Ltd.), NANNEX (Kuraray Co., Ltd.) or HEIM (Toyobo, Ltd.) made by polymerization of monomers with addition of a flame retarding agent such as a phosphorus-based one.

A useful flame retarded fiber substrate of a flame-retardant fabric for ink-jet recording as referred to in the present invention may be prepared from a non-flame-retardant cloth by treating the cloth with a publicly-known flame retarding agent, such as a halogen-based compound, phosphate-based compound, phosphorus-based compound or inorganic compound, dissolved, emulsified or dispersed in water with or without a resin binder in the water in order to make it flame retardant. Among various types of flame retarded cloth as mentioned above for use as a substrate of a flame-retardant fabric for ink-jet recording according to the present invention, polyester fiber is preferable for use in the present invention in terms of its strength, durability and dimensional stability.

Any flame retarded cloth as described above, when subsequently treated to form an ink accepting layer on the cloth for conversion into a fabric for ink-jet recording, fails to give sufficient flame retardancy as a whole unless the ink accepting layer has been flame retarded, causing the cloth's printing side to become flame retardant. Accordingly, the present invention has proposed for formation of an ink accepting layer on a flame retarded cloth as a substrate of an ink-jet recording fabric with a flame retarding agent contained in part of the ink accepting layer (which specifically constitutes its bottom sub-layer according to the present invention) in order to provide the resultant ink-jet recording fabric with sufficient flame retardancy. As a general rule, fabric for ink-jet recording is dependent upon the ink acceptability of the ink accepting layer formed on the fabric, onto which ink is directly dropped, or the color shade depth and brilliancy of the images rendered on it. Therefore, in a fabric with an ink accepting layer, the ink acceptability is insufficient, fails to render deep and brilliant shade color images, especially ink of water-insoluble coloring matter (such as pigment) dispersed in water is applied onto such an ink accepting layer, resulting in the coloring matter in the ink being coagulated in the layer.

Commonly available flame retarding agents consist of active ingredients, and their dispersants and/or viscosity improvers as required, most of which lack ink acceptability. Accordingly, formation of an ink accepting layer on fabric for ink-jet recording with any such flame retarding agent contained in the layer in its entirety, as described above, results in significantly deteriorated color shade of images rendered on the fabric. Therefore, the present invention has proposed treating a flame retarded cloth as a substrate of fabric for ink-jet recording so as to form an ink accepting layer on the cloth, constituting two sub-layers—top and bottom—with a flame retarding agent contained only in the bottom sub-layer, to provide the layer as a whole with sufficient flame retardancy, while maintaining its ink acceptability at the same level of that of its non-flame-retardant counterpart.

It is reasonably understandable that the top or bottom sub-layer of the present invention may be modified so that it is of multi-layer structure to increase the thickness of the ink accepting layer unless such sub-layer structure results in failure to achieve the purpose of the present invention. The present invention has the advantage of providing a fabric substrate with the function of preventing the ink applied to it from bleeding or penetrating through it to its back side and the function of being flame retardant only by taking into consideration the ink accepting layer to be formed on it, which fact, in turn, allows its intended treatment for the purpose of the present invention to be achieved in simple and efficient manner as described herein. In addition, the present invention is extremely advantageous in only treating a fabric substrate to form an ink accepting layer on its one side at least without any flame retardant layer on its other side to provide it with both the function of preventing the ink applied to it from bleeding or penetrating through it to its back side and the function of being flame retardant, thus having no adverse effects on its bending resistance.

Flame retarding agents that are useful in forming the sufficiently flame-retardant ink accepting layer of the present invention can comprise any of a variety of publicly-known flame retardants including, but not limited to, halogen-based flame-retardant compounds, phosphorus-based flame-retardant compounds, inorganic flame-retardant compounds, nitrogen containing flame-retardant compounds and silicone-based flame-retardant compounds. Said halogen-based flame retardant compounds include hexabromocyclododecane, tetrabromobisphenol A and polybromobiphenyl ethers.

Said phosphorus-based flame-retardant compounds include phosphate compounds such as tributoxyethyl phosphate, trihexyl phosphate, tricresyl phosphate, tris(2,3-dibromopropyl) phosphate, tris(2,3-dichloropropyl) phosphate, tris(1,3-dichloropropyl) phosphate, tris(2-chloroethyl) phosphate, bis(3-chloroethyl) vinylphosphonate and triarylphospahte, and phosphorus compounds such as orthophosphoric acid, ammonium phosphate, ammonium polyphosphate, urea phosphate, guanyl urea phosphate, polyphosphoryl amide, melamine phosphate, ammonium polyphosphoryl amide, phosphoryl trianilide, phosphonitrile, tris(2-carbamoylethyl) phosphine, tris(2-carbamoylethyl) phosphine oxide, phosphoryl amide, phosphine amide and vinyl phosphonate.

Said inorganic flame-retardant compounds include antimony trioxide, antimony trichloride, zinc chloride, tin chloride and zinc borate. Said nitrogen-containing flame-retardant compounds include trimethylol melamine and N-methylol acrylamide.

Said silicone-based flame-retardant compounds include silicone elastomers, silicon oils and commercially-available products XC99-B5664, DC4-7045, DC4-7051 and DC4-7081 (all made by GE Toshiba Silicones Co., Ltd.) and EPX-02 (made by Shin-Etsu Chemical Co., Ltd.).

Notwithstanding the above, however, considering the recent worldwide trend toward environmental protection, it is preferable to embody the present invention without use of halogen-based flame-retardant compounds, especially polybromobiphenyl ethers and polybromobiphenyls. In addition, the present invention involves the treatment of a cloth as a substitute of fabric for ink-jet recording to form an ink accepting layer on the surface of the cloth mainly by coating it with an ink acceptor, preferably compatible with aqueous solvent or water from the point of view of safety and environmental protection, which, in turn, recommends that a useful flame retarding agent of the present invention to be added to such an ink acceptor should be readily soluble or dispersible in water or aqueous solvent.

Such useful flame retarding agents of the present invention include phosphon carboxylic acid amide derivatives, organic phosphorus/nitrogen containing compounds, organic phosphorus/halogen containing compounds, phosphorus/halogen compounds, phosphorus/sulfoamide compound complexes, alkyl phosphate derivatives, amino resin phosphates, halogen-containing sulfamide compounds, guanyl sulfonamide compounds, halogen-containing nitrogen compounds, sulfur-containing nitrogen compounds, organic phosphate-based nitrogen/halogen containing compounds, organic halogen-containing phosphate compounds and cyclic halogen complexes.

The top sub-layer formed on a fiber substrate with no flame retarding agent contained in it according to the present invention is preferably 3 $\mu$m to 12 $\mu$m in thickness. If the top sub-layer formed containing no flame retarding agent according to the present invention is below 3 $\mu$m in thickness, it is subject to transfer of the flame retarding agent contained in the bottom sub-layer formed just below it in accordance with the present invention to its surface, causing deterioration in the color shade depth and brilliancy of the images printed onto it. Conversely, if the top sub-layer formed containing no flame retarding agent according to the present invention is above 12 $\mu$m in thickness, it tends to become so thick in relation to the bottom sub-layer formed containing a flame retarding agent below it in accordance with the present invention as to cause the ink accepting layer composed of both sub-layers to fail to possess sufficient flame retardancy as a whole. It should be noted that a fiber substrate treated with an ink acceptor to form an ink accepting layer on it at a given thickness according to the present invention is to be subsequently subjected to such a process as drying for its thermal treatment at 100° C. to 200° C. as described herein later.

The bottom sub-layer formed on a fiber substrate according to the present invention preferably contains a flame retarding agent so that its active ingredient accounts for 4 to 30 weight % of the ink accepting layer formed of both sub-layers on the substrate as a whole in accordance with the present invention. If the flame retarding agent contained in the bottom sub-layer of the present invention in terms of its active ingredient accounts for less than 4 weight % of the ink accepting layer formed of both sub-layers, it is not sufficient to make up for the non-flame-retardancy of the top sub-layer, causing the ink accepting layer to fail to give sufficient flame retardancy as a whole. Conversely, if the flame retarding agent contained in the bottom sub-layer of the present invention in terms of its active ingredient accounts (for more than 30 weight % of the ink accepting layer formed of both sub-layers, it may be more than sufficient to cover the non-flame-retardancy of the top sub-layer without being expected to increase in its effect according to the amount of its use, but only incurring a cost increase. In addition, a useful flame retarding agent of the present invention is preferably a water-insoluble retardant dispersed in water so that its active ingredient is applied onto a fiber substrate of the present invention in an aqueous dispersion. Notwithstanding the above, a useful flame retarding agent of the present invention can also comprise any of publicly-known water-soluble flame retardants, although it should be understood that such a flame retardant is poor with respect to water resistance an its use as a flame-retardant component of the bottom sub-layer of the present invention results in a limited scope of application of the resultant fabric for ink-jet recording.

Ink acceptors that are useful in forming an ink accepting layer (excluding a flame retarding agent) on a fiber substrate according to the present invention can primarily include any of a variety of binders, water-retentive or water-absorptive fine particles, and cationic resins and other similar materials. Useful ink acceptors of the present invention may contain any of anti-oxidants, UV absorbers, anti-desiccants, viscosity controllers pH controllers and other additives that may help achieve the objects of the present invention and/or further improve the properties and characteristics of the resultant fabric for ink-jet printing as commercial goods without departing from the scope of the present invention.

Said binders can comprise one or more of starches and their derivatives, carboxymethyl celluloses, caseins, gelatins, polyvinyl alcohols and their derivatives polyvinyl butyral resins, polyethylene imine resins, polyvinyl pyrolidone resins, poly(meth)acrylate resins, acrylate resins, polyurethane resins, polyamide resins, polyacylamide resins, polyester resins, urea resins, melamine resins, styrene-butadiene copolymers, methylmetacrylate-butadiene copolymers, ethylene-vinylacetate copolymers and other similar polymers or copolymers dissolved or dispersed in water, and the above-mentioned polymers or copolymers modified with anionic or cationic residues introduced into them, and other similar publicly-known polymer or copolymer materials.

Said water-retentive or water absorptive fine particles can comprise one or more of inorganic pigments such as aluminum silicate, calcium silicate, magnesium silicate, amorphous silica, alumina, aluminum hydroxide, magnesium hydroxide, calcium carbonate, kaolin, talc, calcium sulfate, barium sulfate, titanium dioxide, smectite, clay, zinc oxide, zinc carbonate, diatomaceous earth and organic pigments such as styrene resin, acrylate resin, urea resin, melamine resin and benzoguanamine resin. Said cationic resins can comprise one or more of polyethylene imine resins, polyamine resins, polyamide resins, polyacrylate resins, polyurethane resins and other cationic polymer compounds.

The useful methods for applying an ink acceptor to a fiber substrate according to the present invention include, without limitation, coating, dipping, laminating, printing (screen, roller, or rotary), spraying and other techniques available for such application.

Among the above-mentioned application methods, the particularly preferable method for the present invention is coating which can be provided by gravure roll coater, reverse roll coater, kiss roll coater, roll-on-roll coater, knife-on-roll coater, knife-on-bed coater, floating knife coater and other coater systems that allow an ink acceptor of the present invention to be applied to a fiber substrate in such a manner as to provide a fabric for ink-jet recording claimed in the present invention.

A useful process for manufacturing a flame-retardant fabric for ink-jet recording according to the present invention can be achieved by using a flame retarded cloth as a substrate of the flame-retardant fabric as described with reference to the accompanying drawings. FIG. 1 illustrates a dipping system (dipper 1) to apply a flame-retardant finish to a cloth as a substrate of a fabric for ink-jet recording of the present invention and a drying system (dryer 2) linked with the dipping system to dry the flame retardant finished cloth immediately after such finishing. According to the present invention, the flame-retarded cloth as described above is subjected to treatment by two major processes as described below to form an ink accepting layer made up of two sub-layers—top and bottom—on the cloth to produce a fabric for ink-jet recording of the present invention. Specifically, the flame-retarded cloth is first treated by the process of forming a bottom sub-layer containing a flame retarding agent on it.

FIG. 2(A) illustrates a specific example of the bottom sub-layer forming process involving the use of a knife-on-bed coater (indicated by 3 in the figure) to apply an ink acceptor containing a flame retarding agent to the surface of a flame retarded cloth as a substrate of a fabric for ink-jet recording of the present invention. It should be noted that this knife-on-bed coater system is only one of the application methods available for the bottom sub-layer forming process of the present invention, which can also be carried out by using such application methods as mentioned herein earlier, provided, however, that the resultant bottom sub-layer is formed containing a flame retarding agent so that its active ingredient accounts for 4 to 30 weight % of the ink accepting layer made up of both sub-layers as a whole as claimed in the present invention.

As shown in FIG. 2(A), the flame retarded cloth (indicated by F in the figure) subjected to the bottom sub-layer forming process is then passed through a dryer (indicated by 2 in the figure) for heat treatment (for example, at 140 to 150° C. for one minute) [first drying process] to form a bottom sub-layer referred to herein above (indicated by A1 in the figure) on the cloth F. The flame retarded cloth subjected to the first drying process as described above is then treated by the process of forming a top sub-layer containing no flame retarding agent on the bottom sub-layer formed on it [top sub-layer forming process].

FIG. 2(B) illustrates a specific example of the top sub-layer forming process involving the use of a knife-on-bed coater (indicated by 3 in the figure) to apply an ink acceptor containing no flame retarding agent to the surface of the bottom sub-layer formed on the flame retarded cloth. As shown in FIG. 2(B), the flame retarded cloth (indicated by F in the figure) with the bottom sub-layer (indicated by A1 in the figure) on it, after subjected to the top sub-layer forming process, is then passed through a dryer (indicated by 2 in the figure) for heat treatment (for example at 140 to 150° C. for one minute) to form a top sub-layer referred to herein above (indicated by A2 in the figure) on the bottom sub-layer A1, both constituting an ink accepting layer of the present invention (indicated by A in the figure) on the cloth F to manufacture a fabric for ink-jet recording of the present invention, provided, however, that the resultant top sub-layer should be preferably 3 to 12 $\mu$m in thickness pursuant to the present invention. It should be noted that the bottom or top sub-layer forming process of the present invention can e performed so that the resultant bottom or top sub-layer is of multi-layer structure as required unless such sub-layer structure results in failure to achieve the purpose of the present invention.

Ink-jet printing on a flame retardant fabric for ink-jet recording manufactured according to the present invention as described above allows the ink to be deposited onto the ink accepting layer formed on the fabric to convert it into commercial goods (such as full-color printed hanging screens and banners). A flame-retardant fabric for ink-jet recording of the present invention is preferably ink-jet printed with ink of water-insoluble coloring matter such as organic or inorganic pigment dispersed in water or organic solvent.

The reason for preferred use of such ink in the present invention is that it is prone to coagulate on the surface of a useful ink accepting layer of the present invention with resultant poor color shade depth and saturation, and is low in coloring power, requiring it to be applied onto the ink accepting layer in a large quantity, which fact, in turn, contributes to increased effects of the present invention. Notwithstanding this, however, a flame-retardant fabric for ink-jet recording of the present invention can also be inkjet printed with water-based dye ink such as reactive dyes, acid dyes, direct dyes, disperse dyes or other water soluble or dispersible dyes dissolved or dispersed in water, or solvent-based dye ink such as disperse dyes, solvent dyes or other water-insoluble dyes dissolved in organic solvent, unless the resultant ink-jet printed fabric is thereafter subjected to any process for removal of its ink accepting layer.

EXAMPLES

To further illustrate certain embodiments and aspects of the present invention, but not to imply any limitation of the scope of the present invention, the following examples are given together with comparative examples, which are not based on the present invention. The ink acceptors used to form an ink accepting layer on a cloth as a substrate of ink-jet recording fabric in the examples and comparative examples were prepared according to the recipes specified in Table 1 to give four types of emulsions—A, B, C and D.

TABLE 1

| | Emulsion A | Emulsion B | Emulsion C | Emulsion D |
|---|---|---|---|---|
| Binder: PASCOL JK830 | | | | |
| (Aqueous emulsion of cationic urethane resin with a solid content of 30%, made by Meisei Chemical Works, Ltd.) | 50.0% | 50.0% | 50.0% | 50.0% |
| Water-absorptive fine particles: MIZUKASIL | | | | |
| (Silica gel with a solid content of 100%, made by Mizusawa Industrial Chemicals, Ltd.) | 15.0% | 15.0% | 15.0% | 5.0% |
| Cationic polymer: SUMIREZ RESIN 1001 | | | | |
| (Aqueous solution of cationic polymer with a solid content of 30%, made by Sumitomo Chemical Co., Ltd.) | 8.0% | 8.0% | 8.0% | 8.0% |
| Flame retarding agent "a": PHOSCON MK-10B | | | | |
| (Aqueous emulsion halogen-based alicyclic compound with an active ingredient of 42% and a solid content of 45%, made by Meisei Chemical Works, Ltd.) | | 15.0% | 6.0% | |
| Flame retarding agent "b": NICCA FINON P-3 | | | | |
| (Aqueous solution of phosphorus-based compound with an active ingredient of 35%, Nicca Chemical Co., Ltd.) | | | | 19.0% |
| Deionized water | 27.0% | 12.0% | 21.0% | 8.0% |
| Total | 100% | 100% | 100% | 100% |

As shown in the table, the ink acceptors comprised a cationic urethane resin emulsion as its binding component, a gel type silica (with an average particle size of 3.3 $\mu$m and an oil absorptive capacity of 250 ml/100 g) as its water-absorptive fine particle component and a cationic polymer as its fixing component. The flame-retardant ink acceptors—emulsions B, C and D—were prepared containing either of two types of flame retarding agents—a water-insoluble halogen-based alicyclic compound emulsified in water (hereinafter referred to as flame retarding agent "a") and a water-soluble phosphorus-based compound dissolved in water (hereinafter referred to as flame retarding agent "b").

Emulsion A containing no flame retarding agent was used as a top coat applied to a substrate cloth to constitute the top sub-layer of the ink accepting layer on the cloth with its active flame retardant component assumed as 0 (zero) % in a dry state. Emulsion B containing flame retarding agent "a" was used as a base coat applied to a substrate cloth to constitute the bottom sub-layer of the ink accepting layer on the cloth with its active flame retardant component assumed as approximately 16% in a dry state. Emulsion C containing flame retarding agent "a" and Emulsion D containing flame retarding agent "b" were used similarly with their respective active flame retardant components assumed as approximately 7% and 17% in a dry state. The substrate of the fabric for ink-jet recording manufactured in the examples and comparative examples was prepared using two types of polyester plain-weave cloth—cloth A (Teijin Ltd.-made flame-retardant polyester cloth SUPER EXTER woven with flame-retardant fiber used for its weft yarn) and cloth B (polyester cloth woven with ordinary fiber used both for its warp and weft)—as shown in Table 2.

TABLE 2

| | Cloth A (Flame-retardant polyester cloth) | Cloth B (polyester cloth) |
|---|---|---|
| Warp density | 56 yarns/inch | 56 yarns/inch |
| Weft density | 50 yarns/inch | 50 yarns/inch |
| Warp yarn | 150 deniers/48 filaments | 150 deniers/48 filaments |
| Weft yarn | 300 deniers/96 filaments (flame-retardant fiber) | 300 deniers/96 filaments |

Example 1

Cloth A (shown in Table 2) was treated with Emulsion B (shown in Table 1) using a knife-on-bed coater system to form a 5_m-thick coating layer (which corresponds to an "ink accepting layer" referred to in the present invention, hereinafter defined as such) on it as a base coat (which corresponds to a "bottom sub-layer" referred to in the present invention, hereinafter defined as such) and then subjected to heat treatment at 140° C. for one minute. The cloth was then treated with Emulsion A (shown in Table 1) in a similar manner to form another coating layer on it as a top coat (which corresponds to a "top sub-layer" referred to in the present invention, hereinafter defined as such) before being heat-treated to manufacture a fabric for ink-jet recording with an ink accepting layer formed on it, consisting of two sub-layers, top and bottom, with a total coating thickness of 10 $\mu$m.

Example 2

Cloth A (shown in Table 2) was treated with Emulsion B (shown in Table 1) using a knife-on-bed coater system to form a 10 $\mu$m-thick coating layer on it as a base coat and then subjected to heat treatment at 140° C. for one minute. The cloth was then treated with Emulsion A (shown in Table 1) in a similar manner to form another 10 $\mu$m-thick coating layer on it as a top coat before being heat-treated to manufacture a fabric for ink-jet recording with an ink accepting layer formed on it, consisting of two sub-layers, top and bottom, with a total coating thickness of 20 $\mu$m.

Example 3

This example was implemented pursuant to Example 1, except that the top coat was formed with a thickness of 2 $\mu$m, to manufacture a fabric for ink-jet recording, which was only different from the one manufactured in Example 1 in their top coat thicknesses.

Example 4

This example was implemented pursuant to Example 1, except that the top coat was formed with a thickness of 15 μm, to manufacture a fabric for ink-jet recording, which was only different from the one manufactured in Example 1 in their top coat thicknesses.

Example 5

This example was implemented pursuant to Example 1, except that the base coat was formed using Emulsion C (shown in Table 1), to manufacture a fabric for ink-jet recording, which was only different from the one manufactured in Example 1 in that the former had a lower flame retarding agent content in its base coat than the latter.

Example 6

This example was implemented pursuant to Example 1, except that the base coat was formed using Emulsion D (shown in Table 1), to manufacture a fabric for ink-jet recording, which was only different from the one manufactured in Example 1 in the types of the flame retarding agents contained in their base coats.

Comparative Example 1

Cloth B (shown in Table 2) was treated in the same manner as described in Example 1 to manufacture a fabric for ink-jet recording, which was only different from the one manufactured in Example 1 in their cloth substrates.

Comparative Example 2

Cloth A (shown in Table 2) was treated with Emulsion A (shown in Table 1) using a knife-on-bed coater system to form a 10 μm-thick coating layer on it and then subjected for heat treatment at 140° C. for one minute to manufacture a fabric for ink-jet recording with an ink accepting layer formed on it as a single layer with a total coating thickness of 10 μm.

Comparative Example 3

This comparative example was implemented pursuant to Comparative Example 2, except that Emulsion B (shown in Table 1) was used instead of Emulsion A, to manufacture a fabric for ink-jet recording, which was only different from the one manufactured in Comparative Example 2 in the types of the emulsions used to form their coating layers.

Comparative Example 4

Cloth A (shown in Table 2) was treated with Emulsion A (shown in Table 1) using a knife-on-bed coater system to form a 5 μm-thick coating layer on it as a base coat and then subjected to heat treatment at 140° C. for one minute. The cloth was then treated with Emulsion B (shown in Table 1) in a similar manner to form another coating layer on it as a top coat before being heat-treated to manufacture a fabric for ink-jet recording with an ink accepting layer formed on it, consisting of two sub-layers, top and bottom, with a total coating thickness of 10 μm.

The fabrics for ink-jet recording manufactured in Examples 1 to 6 and Comparative Examples 1 to 4 are summarized in Table 3.

Figure 2:
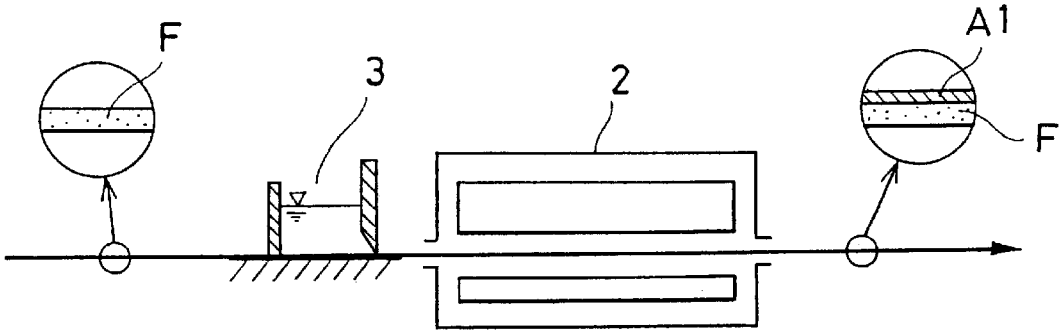
FIGS. 2(A) and 2(B) illustrate a specific process using a knife-on-bed coater system to treat cloth (prepared as shown in FIG. 1) to form a bottom sub-layer and a top sub-layer on the cloth, respectively, according to the present invention.
Figure 2:
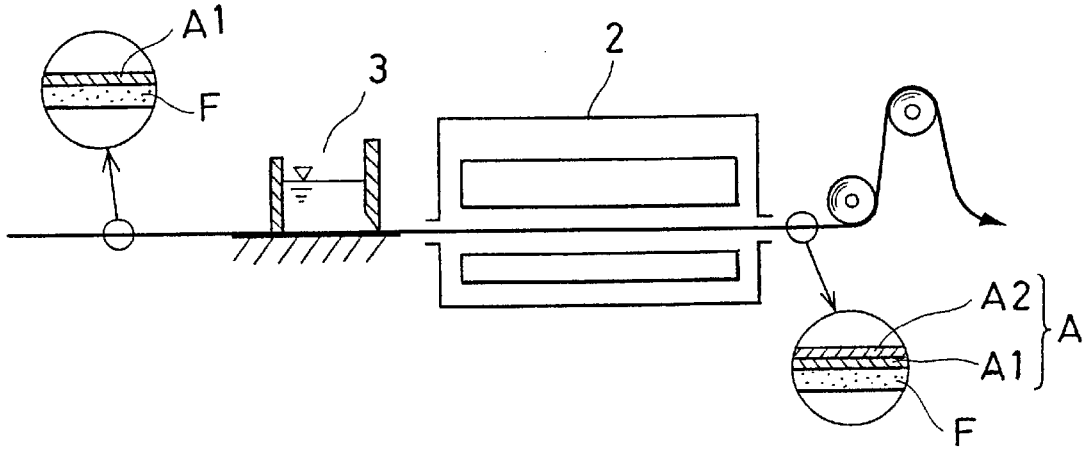

The cross-sectional profile of the fabric for ink-jet recording of the present invention is schematically illustrated in FIG. 2.

TABLE 3

| | Examples | | | | | | Comparative Examples | | | |
|---|---|---|---|---|---|---|---|---|---|---|
| | 1 | 2 | 3 | 4 | 5 | 6 | 1 | 2 | 3 | 4 |
| Substrate | ClothA | ClothA | ClothA | ClothA | ClothA | ClothA | ClothB | ClothA | ClothA | ClothA |
| No. of layers | 2 | 2 | 2 | 2 | 2 | 2 | 2 | 1 | 1 | 2 |
| Base coat emulsion | B | B | B | B | C | D | B | — | — | A |
| Base coat thickness | 5 μm | 10 μm | 5 μm | 5 μm | 5 μm | 5 μm | 5 μm | — | — | 5 μm |
| Top coat emulsion | A | A | A | A | A | A | A | A | B | B |
| Top coat thickness | 5 μm | 10μm | 2 μm | 15 μm | 5 μm | 5 μm | 5 μm | 10 μm | 10 μm | 5 μm |
| Flame retardant type | Water dispersion | Water dispersion | Water dispersion | Water dispersion | Water dispersion | Water solution | Water dispersion | Water dispersion | Water dispersion | Water dispersion |
| Flame retardant content (%) | 8% | 8% | 11% | 4% | 3.5% | 8.5% | 8% | 0% | 16% | 8% |

Each of the fabrics for ink-jet recording manufactured in Examples 1 to 6 and Comparative examples 1 to 4 was treated with four color inks of water-insoluble pigments dispersed in water (yellow, magenta, cyan and black) using a piezo-electric drop-on-demand serial scanning ink-jet recording head (operated under the condition set with a nozzle diameter of 100 μm, a driving voltage of 100V, a frequency of 5 KHz and a resolution of 360 dpi, 4×4 matrix) to ink-jet record color pattern images onto the fabric with an average ink add-on of $1.4\times10^{-2}$ to $5.6\times10^{-2}$ μl/mm$^2$. Each ink-jet printed fabric obtained as described above was then evaluated for flame retardancy, its durability (against exposure to water) and color shade depth according to the following methods for their evaluation. The results of the evaluation are shown in Table 4.

<Fabric Evaluation Methods>

1. Flame Retardancy

The flame retardancy of each fabric was evaluated pursuant to JIS No.L1091 (Test Method for Flammability of Textiles) A-I Method designed to test a textile specimen set at an inclination of 45° for flammability using a micro-burner as an source of ignition (hereinafter referred to as the "45° Micro-burner Method") to subject the specimen to the flame of the micro-burner for a given period of time to burn it for measurement of its burnt area, after flame time, after flame time+after glow time and burnt length, and then pursuant to JIS No.L1091 D Method designed to test a textile specimen rolled and placed into a coil set at an inclination of 45° for flammability using a micro-burner as an source of ignition (hereinafter referred to as the "45° Coil Method") to subject the specimen to the flame of the micro-burner to burn it for measurement of its ignition count required for its complete burning. The results of the test measurements were rated according to the following three-grade (○Δ×) scale specified for each measurement item:

45° micro-burner method

Burnt Area

○: Less than 20 $cm^2$

Δ: Not less than 20 $cm^2$, but less than 30 $cm^2$

×: Not less than 30 $cm^2$

After Flame Time

○: Less than 2 sec

Δ: Not less than 2 sec, but less than 3 sec

×: Not less than 3 sec

After Flame Time+After Glow Time

○: Less than 3 sec

Δ: Not less than 3 sec, but less than 5 sec

×: Not less than 5 sec

Burnt Length

○: Less than 10 cm

Δ: Not less than 10 cm, but less than 20 cm

×: Not less than 20 cm

45° Coil Method

Ignition Count

○: 4 or more

Δ: 3

×: Less than 3

2. Durability of Flame Retardancy Against Exposure to Water

The durability of the flame retardancy of each fabric against exposure to water was evaluated by immersing a test specimen cut from the fabric in running water for 24 hours before subjecting the specimen to the same flame retardancy tests as described in 1 above.

3. Color Shade Depth

The color pattern image recorded on each fabric was evaluated for the shade depth of each of its four colors—yellow, magenta, cyan and black—both by visual observation and measurement with spectrophotometer Macbeth RD918. The results of the visual observation and spectrophotometer measurement were rated according to the following three-grade (○Δ×) scale.

○: High in color shade depth and brilliancy

Δ: Slightly low in color shade depth and brilliancy

×: Extremely poor in color shade depth and brilliancy

4. Dot Shape

The color pattern image recorded on each fabric was observed with a microscope to evaluate the shapes of the dots ink-jet printed to create the image. The results of the microscope observation were rated according to the following three-grade (○×Δ) scale.

○: Completely circular dots with little ink bleed

Δ: Slightly deformed dots with slight ink bleed

×: Fairly deformed dots with large ink bleed

TABLE 4

| | Examples | | | | | | Comparative Examples | | | |
|---|---|---|---|---|---|---|---|---|---|---|
| | 1 | 2 | 3 | 4 | 5 | 6 | 1 | 2 | 3 | 4 |
| Flame retardancy (Initial) 45° Micro-burner Method | | | | | | | | | | |
| Burn area | ○ | ○ | ○ | ○ | ○ | ○ | X | ○ | ○ | ○ |
| After flame time | ○ | ○ | ○ | ○ | ○ | ○ | X | X | ○ | ○ |
| After flame time + After glow time | ○ | ○ | ○ | ○ | ○ | ○ | X | X | ○ | ○ |
| Burnt length | ○ | ○ | ○ | ○ | ○ | ○ | ○ | ○ | ○ | ○ |
| 45° Coil Method - Ignition count | ○ | ○ | ○ | Δ | Δ | ○ | X | X | ○ | ○ |
| Flame retardancy (Durability against exposure to water) 45° Micro-burner Method | | | | | | | | | | |
| Burn area | ○ | ○ | ○ | ○ | ○ | ○ | X | ○ | ○ | ○ |
| After flame time | ○ | ○ | ○ | ○ | ○ | Δ | X | X | ○ | ○ |
| After flame Time + After glow time | ○ | ○ | ○ | ○ | ○ | ○ | X | X | ○ | ○ |
| Burnt length | ○ | ○ | ○ | ○ | ○ | ○ | ○ | ○ | ○ | ○ |
| 45°Coil Method - Ignition count | ○ | ○ | ○ | Δ | Δ | Δ | X | X | ○ | ○ |
| Color shade depth | ○ | ○ | Δ | ○ | ○ | ○ | ○ | ○ | X | X |
| Dot shape | ○ | ○ | Δ | ○ | ○ | ○ | ○ | ○ | X | X |
| Overall judgment result (See Note) | ◎ | ◎ | ○ | Δ | Δ | Δ | X | X | X | X |

Note:
◎: Excellent
○: Good
Δ: Fair
X: Poor

The present invention provides a sufficiently flame-retardant fabric for ink-jet recording with an ink accepting layer on its one side at least, the ink acceptability of which is the same as that of its non-flame-retardant counterpart, allowing it to render high image quality (such as color shade depth, saturation and sharpness). Therefore, a flame-retardant fabric for ink-jet recording according to the present invention can offer large-sized full-color goods such as hanging screens and banners with satisfactory color shade depth and brilliancy, and bending resistance superior to that of paper and resin sheet, which have been otherwise used as a substrate of such goods.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A flame retardant fabric for ink jet recording, comprising: a flame retarded fiber substrate, an ink accepting layer disposed on at least one side of said substrate, said ink accepting layer including a bottom layer disposed on said one side of said substrate and comprising an ink acceptor with a flame retarding agent, and a top layer disposed on said bottom layer and comprising an ink acceptor with no flame retarding agent.

2. The flame retardant fabric of claim 1 wherein said flame retarding agent of said bottom layer has an active ingredient which accounts for 4 to 30% of the entire said ink accepting layer by weight.

3. The flame retardant fabric of claim 1 wherein said flame retarding agent is readily soluble or dispersible in water or aqueous solvent.

4. The flame retardant fabric of claim 1 wherein said top layer is 3 to 12 $\mu$m in thickness.

5. The flame retardant fabric of claim 1 wherein said ink accepting layer comprises binders, water-retentive or water absorptive fine particles, and cationic resins.

6. The flame retardant fabric of claim 5 wherein said binders comprise polyurethane resins.

7. The flame retardant fabric of claim 1 wherein said top layer comprises a cationic urethane resin emulsion as a binder, silica gel as a water absorptive component, and a cationic polymer as a fixing component.

8. The flame retardant fabric of claim 7 wherein said bottom layer comprises a cationic urethane resin emulsion as a binder, silica gel as a water absorptive component, a cationic polymer as a fixing component, and an aqueous emulsion halogen-based alicyclic compound as said flame retarding agent.

9. The flame retardant fabric of claim 7 wherein said bottom layer comprises a cationic urethane resin emulsion as a binder, silica gel as a water absorptive component, a cationic polymer as a fixing component, and an aqueous solution of phosphorous-based compound as said flame retarding agent.

10. The flame retardant fabric of claim 9 wherein said substrate comprises one of: flame retardant rayon; flame retardant acrylic fiber; flame retardant vinylon; and flame retardant polyester.

11. The flame retardant fabric of claim 9 wherein said substrate comprises flame retardant polyester.

12. A flame retardant fabric for ink-jet recording comprising: a flame retarded fiber substrate, an ink accepting layer disposed on at least one side of said substrate, said ink accepting layer including a bottom layer disposed on said one side of said substrate and comprising an ink acceptor with a flame retarding agent, said flame retarding agent having an active ingredient which accounts for 4 to 30% of the entire said ink accepting layer by weight and which is applied to said substrate in an aqueous dispersion, and a top layer disposed on said bottom layer and comprising an ink acceptor with no flame retarding agent, said top layer having a thickness of 3 to 12 $\mu$m.

13. The flame retardant fabric of claim 12 wherein said top layer comprises a cationic urethane resin emulsion as a binder, silica gel as a water absorptive component, and a cationic polymer as a fixing component.

14. The flame retardant fabric of claim 13 wherein said bottom layer comprises a cationic urethane resin emulsion as a binder, silica gel as a water absorptive component, a cationic polymer as a fixing component, and an aqueous emulsion halogen-based alicyclic compound as said flame retarding agent.

15. The flame retardant fabric of claim 13 wherein said bottom layer comprises a cationic urethane resin emulsion as a binder, silica gel as a water absorptive component, a cationic polymer as a fixing component, and an aqueous solution of phosphorous-based compound as said flame retarding agent.

16. The flame retardant fabric of claim 15 wherein said substrate comprises one of: flame retardant rayon; flame retardant acrylic fiber; flame retardant vinylon; and flame retardant polyester.

* * * * *